US006604942B2

(12) United States Patent
Sharp

(10) Patent No.: US 6,604,942 B2
(45) Date of Patent: Aug. 12, 2003

(54) HOT WATER TOWEL WARMER

(76) Inventor: J. Keith Sharp, 603 Governors Dr. SW., Huntsville, AL (US) 35801

( * ) Notice: Subject to any disclaimer, the term of this patent is extended or adjusted under 35 U.S.C. 154(b) by 106 days.

(21) Appl. No.: 09/805,329

(22) Filed: Mar. 13, 2001

(65) Prior Publication Data

US 2002/0129514 A1 Sep. 19, 2002

(51) Int. Cl.[7] ..... H05B 3/06
(52) U.S. Cl. ..... 432/266; 219/520; 219/521
(58) Field of Search ..... 432/266, 184, 432/185, 225, 249, 250; 122/493, 498; 219/385, 217, 218, 521, 400, 386, 520, 243; 126/271.1

(56) References Cited

U.S. PATENT DOCUMENTS

| | | | | |
|---|---|---|---|---|
| 4,559,442 A | | 12/1985 | Graham | |
| 4,644,136 A | | 2/1987 | Watchman | |
| 4,684,787 A | * | 8/1987 | Bunting | 219/400 |
| 4,694,146 A | | 9/1987 | DeMars | |
| 4,849,610 A | | 7/1989 | Alvarez | |
| 4,927,995 A | | 5/1990 | Lovett et al. | |
| 5,569,403 A | | 10/1996 | Swanson et al. | |
| 5,736,714 A | * | 4/1998 | Bechtold, Jr. | 219/521 |
| 6,046,436 A | * | 4/2000 | Hunts | 219/400 |
| 6,080,974 A | * | 6/2000 | Ambrosiano | 219/544 |

* cited by examiner

*Primary Examiner*—Gregory Wilson
(74) *Attorney, Agent, or Firm*—Lanier Ford Shaver & Payne P.C.

(57) ABSTRACT

A towel warmer comprising a cabinet enclosing a chamber with an opening, a door attached to the cabinet to close the opening, one or more coils heated by conducting hot water, the coils being positioned within the chamber opposite the opening, a resilient compressible support positioned on the door to compress cloth-like objects against the heated coils as the door is closed, and a latch to hold the door closed with force to maintain compression of the cloth-like objects against the heated coils.

25 Claims, 3 Drawing Sheets

HOT WATER TOWEL WARMER

BACKGROUND OF THE INVENTION

1. Field of the Invention

The invention relates to towel warming devices and, particularly, to a towel warmer cabinet that warms towels with hot water moving through a coil using passive energy only.

2. Background of the Invention

Typical towel warming cabinets have chambers with fans or blower motors contained therein and also have air intake and exhaust vents, or re-circulate air. Most of these devices are complex, having moving parts and electric heating elements. These devices are constructed in this manner because hanging towels or towels resting on a shelf or platform contain a substantial amount of air and do not conduct heat satisfactorily. Unless there is a vigorous airflow around and through the towel, the towel will become warm only in certain areas and not uniformly. Heat through radiation alone is consistently less effective than with an air flow mechanism. An alternative device is one which can sandwich a towel between several electric heating plates. This type of device is also complex and requires electric power.

SUMMARY OF THE INVENTION

The present invention is a cabinet which warms towels or other cloth-like materials, such as clothes, linens, etc. by compressing the materials against coils heated by hot water. The cabinet has top, bottom, side, and rear walls which define a chamber or enclosure therein. A door is hinged to the front of the chamber and opens and closes the frontal entry to the chamber. When the door is closed, the chamber is completely enclosed with no venting. The cabinet has one or more coils located on the rear wall within the chamber. The coil is connected in series with a hot water supply so that hot water flows through the coil before exiting a hot water faucet. The portion of the door that faces the chamber and coil when the door is closed has a compressible resilient support which presses a towel or the like against the coil, when the door is latched. The support presses the towel with sufficient pressure to compress the towel against the coil so that there are no air pockets within the towel and heat is, thus, transferred rapidly and uniformly from the coil to the towel as hot water is running through the coil.

An advantage of the present invention is an inexpensive towel warmer that is simple to construct.

Another advantage of the present invention is a towel warmer that uses passive energy to heat towels by using only the hot water used during bathing.

Another advantage of the present invention is a towel warmer with no moving parts.

Another advantage of the present invention is a towel warmer with no risk of electric shock.

Another advantage of the present invention is a towel warmer that may be inset within a wall of a room or shower stall.

Another advantage of the present invention is a towel warmer that compresses a towel against a heat coil so that the towel is heated rapidly and uniformly.

DETAILED DESCRIPTION OF THE PREFERRED EMBODIMENTS

While the following description details the preferred embodiments of the present invention, it is to be understood that the invention is not limited in its application to the details of construction and arrangement of parts illustrated in the accompanying drawings, since the invention is capable of other embodiments and of being practiced in various ways.

Figure 1:
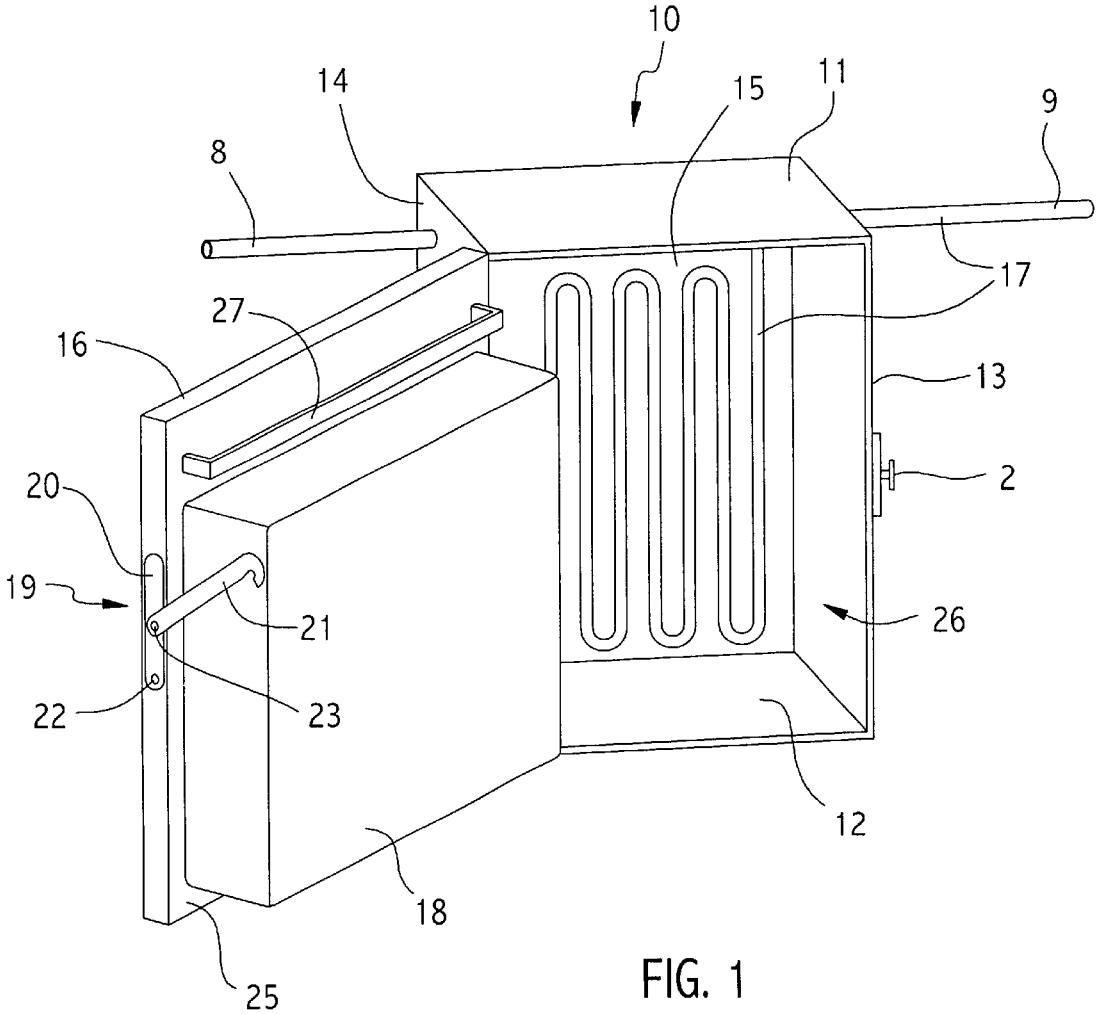
FIG. 1 is a perspective view of the towel warmer cabinet of the present invention.

FIG. 1 shows a perspective view of the hot water towel warmer of the present invention. The towel warmer comprises a cabinet 10 having top 11, bottom 12, right side 13, left side 14, and rear 15 walls, defining an enclosure or chamber with an open frontal entry 26. Cabinet 10 also has a front door 16 which is hingedly attached to cabinet 10, preferably with a piano hinge. The hinge can attach door 16 to any of the walls, preferably a side wall. Coil 17 is positioned on rear wall 15 within the chamber 10. The coil 17 is constructed of metal or plastic, preferably copper, and is adapted to fit in series with a supply of hot water and a faucet, i.e., in between the supply of hot water and a faucet.

On the inner aspect 25 of the door 16 is a resilient compressible support 18 which faces the chamber and coil 17 when the door 16 closes the frontal entry 26 of the chamber of cabinet 10. The support can be composed of any suitable compressible resilient material such as, for example, foam rubber or plastic foam. Numerous types of plastic foam are well known, such as, for example, polyurethane and polyethylene foams. Other compressible supports may be used, such as a platform with compressible resilient springs or coils.

Figure 2:
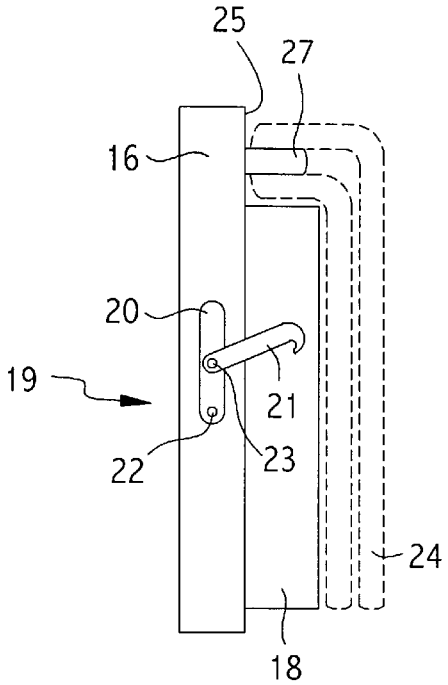
FIG. 2 is a side view of the door of the towel warmer cabinet showing the towel supported by a resilient compressible support.

FIG. 2 shows door 16 with towel holder 27 and resilient compressible support 18, with towel 24 hanging from rack 27 and supported by support 18. Towel holder 27 may also be suspended from top wall 11 within the chamber or hooked to other walls as desired. A plurality of towel holders may be used.

Figure 3:
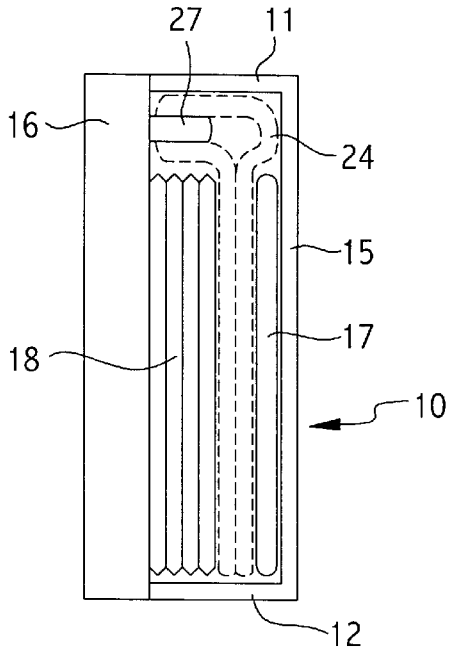
FIG. 3 is a cross-sectional view of the towel warmer cabinet showing the door in the closed position compressing the towel against the coil, with pressure on the towel maintained by the resilient compressible support.

FIG. 3 shows a cross-sectional view of cabinet 10 with door 16 in the closed position. FIG. 3 illustrates how support 18 is compressed thereby pressing towel 24 against coil 17. Because support 18 is resilient, it maintains a spring-like force on towel 24 when it is compressed by closing and latching door 16. When towel 24 is pressed against coil 17 when door 16 is closed over the frontal entry and latched, towel 18 is flattened and there are no longer any airspaces between or around the folds of the towel 24. Thus, heat from coil 17 is rapidly transmitted to the entire towel uniformly. If support 18 is composed of plastic foam it will act as a highly effective insulator, confining the transferred heat from the coil 17 to the towel 24. When door 16 is closed, the chamber is completely enclosed with no venting. Although FIGS. 2 and 3 show towel holder 27, holder 27 is not essential and one or more towels or similar cloth-like articles such as clothing or linens may be placed in the chamber and pressed against coil 17 without a holder 27, rack, or shelf.

Figure 4A:
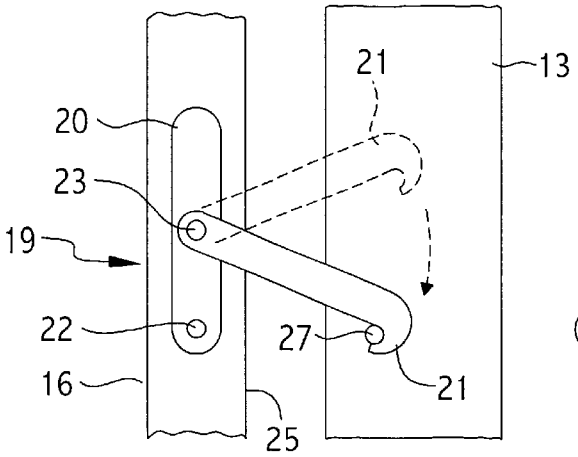
FIG. 4*a* shows an example of a latch to close the door of the towel warmer cabinet with the latch loosely engaging a bolt.
Figure 4B:
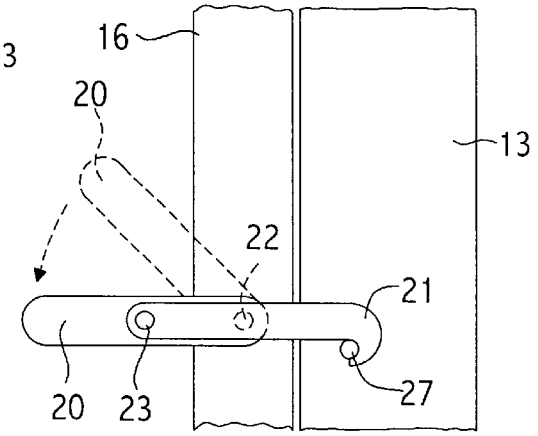
FIG. 4*b* shows the latch of FIG. 4*a* tightened to compress the towel against the coil of the towel warmer cabinet.

FIGS. 4*a* and 4*b* show, by way of example, a typical latch mechanism 19 known in the art that could be used with cabinet 10 to secure door 16 to side wall 13 with varying degrees of tension. Arm 21 fits over bolt 27. Lever 20 pulls door 16 towards wall 13 as lever 20 is pressed downward, lever 20 and arm 21 pivoting on shafts 22 and 23, respectively. Many types of latches can operate with the present invention, the main requirement being that the latch can hold the door 16 closed when support 18 is compressed by closing the frontal opening of cabinet 10 with door 16, thereby generating a force on the door 16 such that it is biased towards an open position.

Figure 5:
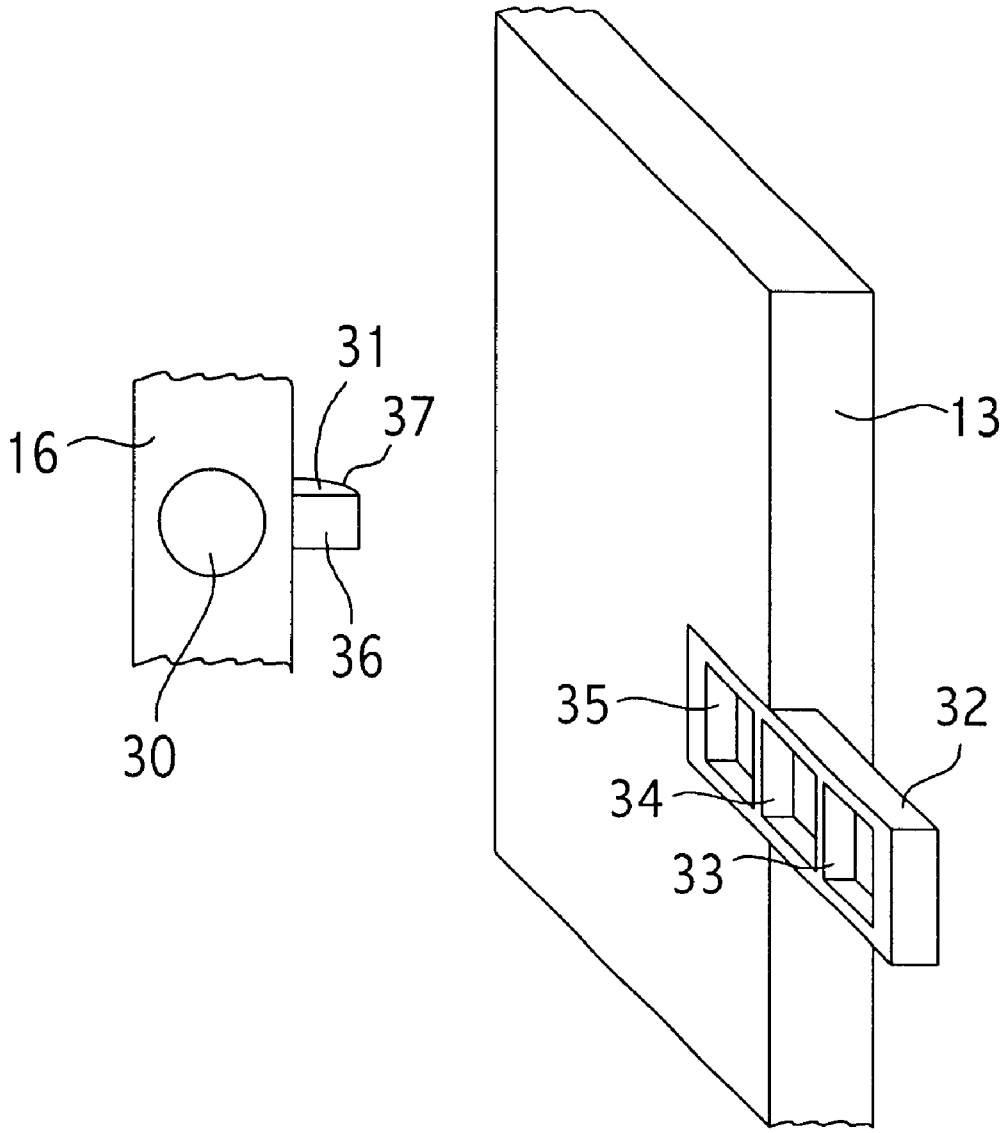
FIG. 5 shows another embodiment of a latch to close the door of the towel warmer cabinet.

Another example of a latching mechanism, known in the art, that can be used to secure door 16 to side wall 13 with varying degrees of tension is shown in FIG. 5. This latch mechanism is a typical assembly of a door knob 30, sliding spring bolt 31, and door jamb receptacles 33–35 used universally with most house hold or office doors. In this example, door jamb 32 has multiple receptacles 33–35 in which bolt 31 will lodge as door 16 is pushed inward to close the frontal opening 26 and chamber of cabinet 10. As door 16 is pushed inward rounded edge 37 of bolt 31 encounters jamb 32 and is compressed into door 16 and door 16 can continue to move forward until a spring in bolt 31, which biases bolt 31 to extend out of door 16, extends bolt 31 into receptacle 33. Since outward surface 36 of bolt 31 is flat, door 16 is locked at that position and cannot open. By applying more pressure to door 16, door 16 advances inward and the jamb 32 encounters rounded edge 37 of bolt 31, pushing bolt 31 into door 16 as before, allowing bolt 31 to encounter receptacle 34. Bolt 31 extends into receptacle 34 and locks door 16 in place. In a similar fashion, more pressure can be applied to door 16, and, hence to support 18 and towel 24, by advancing door 16 to receptacle 35. Door 16 can be unlocked and opened by turning door knob 30 counterclockwise, retracting bolt 31 into door 16, as is well known in the art with these type of door latches. A latching mechanism may be placed on any wall as desired.

The towel warming cabinet of the present invention is easy to construct, install, and use. The cabinet can be made any desired size and shape with any desired chamber volume. The cabinet can be made of wood, plastic, or metal and can be insulated with any suitable insulation by methods known in the art. In addition to one or more heating coils positioned on the rear wall 15 within the chamber, coils may also be placed on the top 11, left 14, right 13, and bottom 12 walls within the chamber as desired.

Referring to FIG. 1, one end 8 of heating coil 17 is connected to a hot water source, such as a hot water pipe extending from a hot water heater. The opposite end 9 of coil 17 is connected to a faucet such as found in a shower, bathtub, or sink. Cabinet 10 can be free-standing, attached to a wall, or built into a wall, as desired. During use, for example, one or more towels are placed in the cabinet up against the heating coil 17. Towels may also be suspended from towel holders placed as desired on the walls within the chamber. The door is closed with force, compressing support 18, thereby pushing and flattening or compressing the towels against the coils. A hot water faucet is opened in a shower, bathtub, or the like, so that hot water flows from the hot water heater through the coil and out of the faucet. The hot water flowing from the hot water heater through the coil will constantly provide heat to the coil. Because the towels are compressed against the coil, heat will transfer rapidly from the coil and into the entire towel uniformly. As heat is taken up from the coil by the towel, the heat lost from the coil is instantly replaced by the continuous flow of hot water. In this manner, the towel is heated at or near the temperature of the hot water within a few minutes, and the towel will remain warm if the cabinet is constructed with standard insulation. When a user is finished taking a typical bath or shower, the towel is warm and ready for use.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the latch may use a suitable hook and eye arrangement; the door may have sealing material to render the cabinet air tight when the door is closed; the support may be made of resilient cloth or pillow-like structures; the coil may have a variety of shapes; the cabinet may have a round, oval, or other shape; the ends of the coils may exit the cabinet at a variety of desired locations; and the door may use a combination of two latches instead of a hinge. The support attached to the door can extend to the edges of the door. The support can be constructed of heat-reflective material.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A towel warmer comprising:

a) a cabinet enclosing a chamber with an opening;

b) a door attached to said cabinet to close the opening of the chamber;

c) said door having a resilient compressible support;

d) one or more copper coils for conducting hot water, said coils positioned within the chamber opposite the opening and connected in series between a hot water source and a faucet; and e) said door having a latch so that said support is maintained compressed when said door is closed and latched, thereby compressing cloth-like objects against said coil to heat the cloth-like objects uniformly and wherein said cabinet is airtight when said door is closed.

2. The towel warmer according to claim 1 wherein said support is made of plastic foam.

3. The towel warmer according to claim 2 wherein said support is constructed of heat-reflective material.

4. The towel warmer according to claim 2 wherein said door is attached to said cabinet with a piano hinge.

5. The towel warmer according to claim 4 wherein said latch comprises a door knob, spring bolt, and one or more door jambs.

6. The towel warmer according to claim 4 wherein said cabinet is composed of plastic.

7. The towel warmer according to claim 6 wherein said cabinet is insulated.

8. The towel warmer according to claim 1 wherein said cabinet has one or more towel holders within the chamber.

9. A towel warmer, comprising:

a) a cabinet having top, bottom, side, and rear walls defining a chamber therein with a frontal opening opposite said rear wall;

b) a door hingedly connected to said cabinet to open and close the frontal opening of the chamber;

c) one or more copper coils within the chamber positioned on said rear wall;

d) said door having a compressible resilient support facing said coil when said door is closed;

e) said coil connected in series between a hot water source and a heater, said coil conducting hot water when said faucet is opened, thereby heating said coil; and f) said door having a latch so that said support presses one or more cloth-like objects against said coil when said door is closed and latched, thereby compressing the cloth-like object and maintaining pressure on the cloth-like object against said coil to heat the cloth-like object uniformly.

10. The towel warmer according to claim 9 wherein said support is made of plastic foam.

11. A towel warmer, comprising:

a) a cabinet having top, bottom, side, and rear walls defining a chamber therein with a frontal opening opposite said rear wall;

b) a door hingedly connected to said cabinet to open and close the frontal opening of the chamber;

c) one or more coils within the chamber positioned on said rear wall;

d) said door having a compressible resilient support facing said coil when said door is closed;

e) said coil connected in series between a hot water source and a heater, said coil conducting hot water when said faucet is opened, thereby heating said coil; and f) said door having a latch so that said support presses one or more cloth-like objects against said coil when said door is closed and latched, thereby compressing the cloth-like object and maintaining pressure on the cloth-like object against said coil to heat the cloth-like object uniformly.

12. The towel warmer according to claim 11 wherein said latch comprises a door knob, spring bolt, and one or more door jambs.

13. The towel warmer according to claim 11 wherein said cabinet is composed of plastic.

14. The towel warmer according to claim 13 wherein said cabinet is insulated.

15. The towel warmer according to claim 9 wherein said cabinet is airtight when said door is closed.

16. The towel warmer according to claim 11 wherein said cabinet has one or more towel holders within the chamber.

17. A method for warming a towel, comprising:

a) providing a cabinet with a chamber, an opening, a door to close the opening, and one or more coils within the chamber opposite the opening, said door having a resilient compressible support;

b) connecting said coil in series in between a hot water source and a hot water faucet;

c) placing one or more cloth-like objects in said chamber, closing and latching said door with force to press said support against said cloth-like object, thereby compressing the cloth-like object and maintaining pressure on the cloth-like object against said coil; and d) opening a hot water faucet so that hot water will flow from the hot water source through said coil and then out the hot water faucet, thereby heating said coil which then warms said cloth-like object uniformly.

18. The towel warmer according to claim 17 wherein said coil is made of copper.

19. The towel warmer according to claim 18 wherein said support is made of plastic foam.

20. The towel warmer according to claim 19 wherein said door is attached to said cabinet with a piano hinge.

21. The towel warmer according to claim 20 wherein said latch comprises a door knob, spring bolt, and one or more door jambs.

22. The towel warmer according to claim 20 wherein said cabinet is composed of plastic.

23. The towel warmer according to claim 22 wherein said cabinet is insulated.

24. The towel warmer according to claim 18 wherein said cabinet has one or more towel holders within the chamber.

25. The towel warmer according to claim 17 wherein said cabinet is airtight when said door is closed.

* * * * *